US005463441A

United States Patent [19]

Yamaguchi

[11] Patent Number: 5,463,441

[45] Date of Patent: Oct. 31, 1995

[54] LEADER, METHODS FOR ATTACHING THE LEADER TO A FILM AND FOR DETACHING IT THEREFROM, AND DEVELOPING APPARATUS WITH AUTOMATIC ATTACHMENT AND DETACHMENT OF THE LEADER

[75] Inventor: Takuji Yamaguchi, Wakayama, Japan

[73] Assignee: Noritsu Koku Co., Ltd., Wakayama, Japan

[21] Appl. No.: 219,473

[22] Filed: Mar. 29, 1994

[30] Foreign Application Priority Data

Apr. 15, 1993 [JP] Japan ..... 5-088843

[51] Int. Cl.[6] ..... G03D 3/08

[52] U.S. Cl. ..... 354/321; 354/339; 354/345; 354/344

[58] Field of Search ..... 354/319–323, 354/345, 346, 334, 344; 352/235; 242/195, 680, 186, 76, 55.1; 226/90–92; 156/502

[56] References Cited

U.S. PATENT DOCUMENTS

| | | | |
|---|---|---|---|
| 1,655,297 | 1/1928 | Thornton | 352/235 |
| 2,433,446 | 12/1947 | Foster | 156/502 |
| 2,590,678 | 3/1952 | Caim | 430/501 |
| 4,110,774 | 8/1978 | Krehbiel et al. | 354/345 |
| 4,134,526 | 1/1979 | Weisser | 226/91 |
| 4,860,044 | 8/1989 | Kanai et al. | 354/321 |

FOREIGN PATENT DOCUMENTS

| | | |
|---|---|---|
| 0242817 | 10/1987 | European Pat. Off. . |
| 0437814 | 7/1991 | European Pat. Off. . |
| 2823934 | 12/1979 | Germany . |

*Primary Examiner*—D. Rutledge

*Attorney, Agent, or Firm*—Armstrong, Westerman, Hattori, McLeland and Naughton

[57] ABSTRACT

There are disclosed a leader for use in developing a film, methods for attaching the leader to the film and for detaching it therefrom, and an apparatus for automatically attaching the leader to the film and detaching it therefrom. The apparatus for automatically attaching the leader to the film includes a leader set cover for holding the leader, a leader guide defining an arcuate path, leader feed means for feeding the leader from the leader set cover to the leader guide, leader backing means for backing the leader to a leader controlling part to curve the leader, and film feed means for feeding the film toward an elongated opening of the leader.

5 Claims, 6 Drawing Sheets

LEADER, METHODS FOR ATTACHING THE LEADER TO A FILM AND FOR DETACHING IT THEREFROM, AND DEVELOPING APPARATUS WITH AUTOMATIC ATTACHMENT AND DETACHMENT OF THE LEADER

BACKGROUND OF THE INVENTION

The present invention relates to a leader to be attached to the leading end of a film for leading the film, methods for attaching the leader to a film and for detaching it therefrom, and a developing apparatus with means for automatic attachment and detachment of the leader.

There is an automatic developing apparatus of the type using a leader for transfer of a film, wherein the leader is attached to the leading end of the film for leading the film to go round in film processing tanks. In attaching the leader to the film, it is a conventional practice to set a cartridge on a splicing bed, cut a tongue portion of the film and bond the leader to the film with a splicing tape by hand.

The aforementioned conventional developing apparatus involves a problem that time and labor are needed for attaching the leader to the film and the splicing tape must be removed after completion of the film processsing. In addition, the apparatus presents another problem in that time and labor must be taken for setting the leader attached to the film on the apparatus.

It is, therefore, an object of the present invention to overcome the foregoing problems and to provide a leader capable of being attached to, and detached from, a film without using a splicing tape, methods for attaching the leader to and detaching it from the film, and a developing apparatus with means for automatic attachment and detachment of the leader which realizes development of the film by merely setting a cartridge containing therein a roll of photographed film on the apparatus at a predetermined position.

SUMMARY OF THE INVENTION

According to one aspect of the present invention, there is provided a leader to be attached at one end portion thereof to a film having an engagement perforation in a leading end portion thereof, comprising:

(a) a pawl formed near one end of a leader body as projecting from a surface of the leader body and having a tip oriented in a direction in which the leader is to be fed;

(b) an elongated opening formed nearer the one end of the leader body than the pawl and having a length slightly larger than a width of the film, the opening having a longitudinal axis extending parallel to an edge of the one end of the leader body; and (c) a pressing plate having a hole for exposing the pawl, disposed on a face of the leader body from which the pawl projects and fixed to a surface of the leader body on a side opposite to a side on which the elongated opening is formed with the pawl intervening between these sides so as to allow the film inserted between the pressing plate and the leader body through the elongated opening to slide therebetween until the engagement perforation of the film engages the pawl.

According to another aspect of the present invention, there is provided a method for attaching the aforesaid leader to the film, comprising the steps of:

(a) curving the leader at the one end portion thereof in such a manner that a transverse axis of the elongated opening extends in a circumferential direction of a resulting substantially circular arc and that the face of the leader body on which the pressing plate is disposed forms an inner periphery of the arc; and (b) inserting the film into the elongated opening from outside of the arc to engage the engagement perforation of the film with the pawl.

According to yet another aspect of the present invention, there is provided a method for detaching the leader from the film, comprising the steps of:

(a) fixedly holding the leader attached to the film;

(b) slightly moving the film toward the leader to disengage the engagement perforation from the pawl; and (c) drawing the film away from the leader while collapsingly pressing the pawl.

According to still another aspect of the present invention, there is provided an apparatus for automatically attaching the leader to the film, comprising:

(a) a leader set cover for holding a plurality of leaders in such a manner that each of the leaders is positioned as having the one end portion for film attachment lying rearward;

(b) a leader guide defining an arcuate path;

(c) leader feed means for feeding each of the leaders held by the leader set cover to the leader guide;

(d) leader backing means provided adjacent one end of the leader guide for moving backward the leader fed to the leader guide;

(e) a leader controlling part for controlling the one end portion of the leader moved backward by the leader backing means to curve the one end portion of the leader along the leader guide; and (f) film feed means for drawing the film out of a cartridge accommodating the film in the form of a roll to feed the film toward the elongated opening of the leader which is kept curved at the one end portion thereof, whereby the leading end of the film having the engagement perforation is attached to the leader.

According to a further aspect of the present invention, there is provided an apparatus for automatically detaching the leader from the film, comprising:

(a) leader feed means for fixedly holding the leader attached to the film and then feeding the leader;

(b) pawl presser means for collapsingly pressing the pawl of the leader; and (c) film forwarding and backing means, provided adjacent the pawl pressing means and on a side adjacent a passage of the film, for forwarding and backing only the film with the leader fixedly held.

With the leader of the present invention, a film having an engagement perforation at its one end portion can be easily set on the leader by merely inserting the film into an elongated opening of the leader. In the apparatus for automatically attaching the leader to the film according to the present invention, the leader is held as curved, and the film is drawn out of a cartridge and inserted into the elongated opening of the leader, whereby the leader is attached to the film. Further, in the apparatus for automatically detaching the leader from the film according to the present invention, the leader is detached from the leader by drawing the film while collapsingly pressing the pawl of the leader.

DETAILED DESCRIPTION

The present invention will now be described in detail with reference to the attached drawings.

Figure 1:
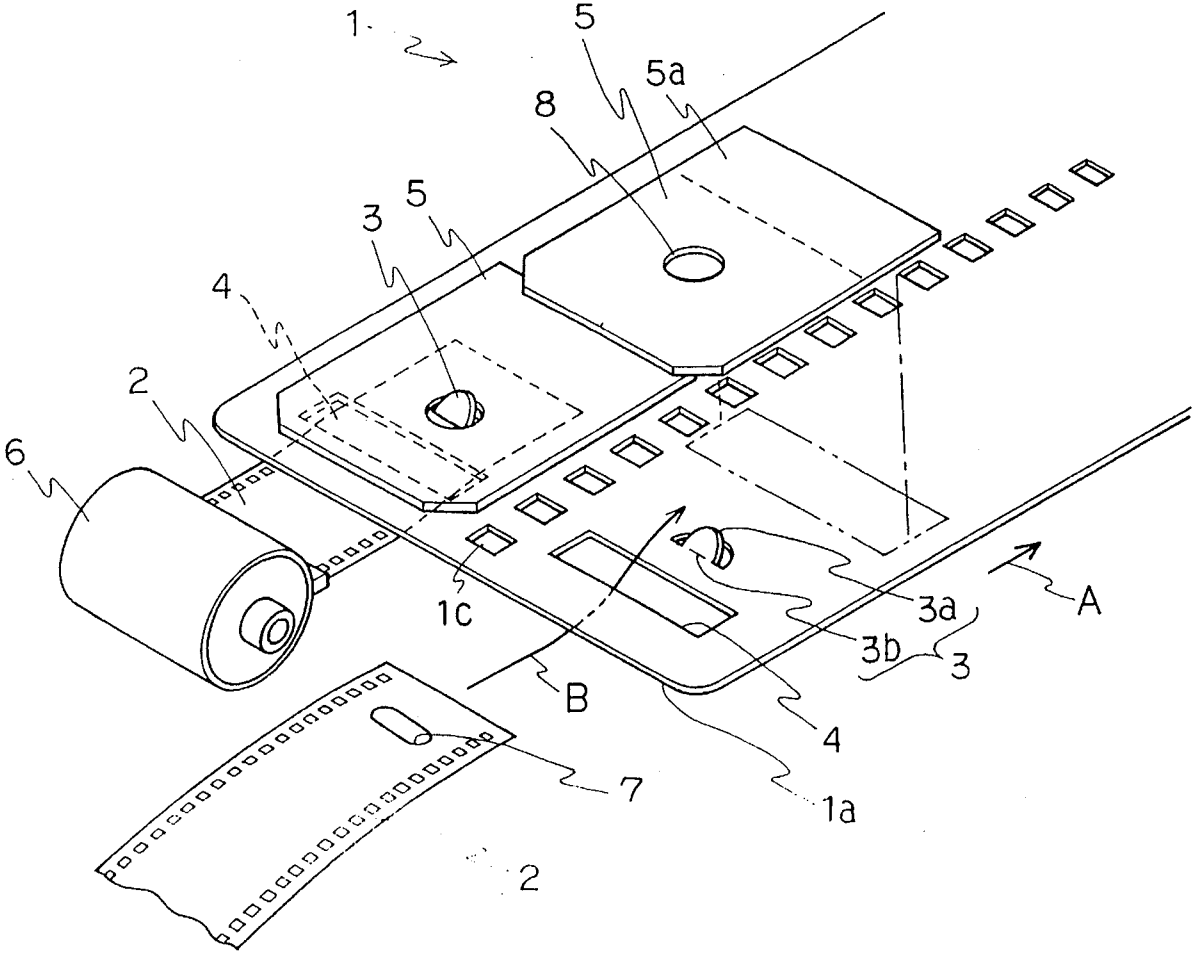
FIG. 1 is an explanatory view illustrating a principal portion of a leader according to the present invention.

Referring to FIG. 1, a leader 1 comprises a thin plate having flexibility and is adapted to be attached at its one end portion to a film 2 for leading the film 2 to go round in a development processing part of a developing apparatus. The leader 1 includes a pawl 3 in the end portion to which the film 2 is to be attached, an elongated opening 4 formed nearer the end of the leader than the pawl 3, and a pressing plate 5 mounted on the leader body to cover the elongated opening 4 and pawl 3.

The film 2 is rolled and supported within a cartridge 6, and the tongue portion of the film 2 is cut off in advance. An elliptic engagement perforation 7 is punched at an approximate central of the end portion of the film 2 on the side where the tongue portion is cut off in advance. The engagement perforation 7 is adapted to engage the pawl 3. Note that the engagement perforation 7 might be reinforced by bonding a tape to the portion to be punched of the film 2 and then punching that portion.

The pawl 3 of the leader 1 is positioned at a location allowing engagement of the pawl 3 with the engagement perforation 7 of the film 2 which is inserted through the elongated opening 4. The pawl 3 is projected upwardly with its tip 3*a* oriented in a direction in which the leader 1 is to be fed. In the embodiment shown in FIG. 1, the pawl 3 is formed by cutting a semi-ring-shaped hole and then upwardly bending the semi-circular portion resulting from the cutting at its root portion 3*b*. The leader 1 is made of any material having a flexibility and exhibiting a characteristic such that a portion once plastic-deformed by bending maintains resilence to some extent. Where the leader 1 is made of such material, the pawl can be collapsingly pressed and, upon released from the pressing force, can restore its bent condition. Such behavior is needed to detach the film 2 from the leader 1, and the detachment of the film from the pawl 3 can be easily achieved by drawing the film 2 with the pawl 3 kept collapsingly pressed. Where the leader 1 is not made of such material, the pawl 3 might be formed in a separate member of the aforementioned properties by bending a tip of the member and bonded to the leader at its root portion. Since the tip 3*a* is oriented in the leader feed direction, the film 2 will not be disengaged from the pawl 3 even if the film 2 is drawn in the leader feed direction (indicated by arrow A).

The elongated opening 4 is formed nearer the end of the leader 1 than the pawl 3 in such a manner that a longitudinal axis thereof extends parallel to the end edge 1*a* of the leader 1. The length of the elongated opening 4 is slightly larger than the width of the film 2. As shown in FIG. 1, the film 2 is inserted from below the leader 1 through the elongated opening 4, so that the engagement perforation 7 of the film engages the pawl 3.

The pressing plate 5 is provided to cover the pawl 3 and the elongated opening 4, presses the film 2 inserted through the elongated opening 4 to allow it to slide on the surface of the leader 1, guides the film 2 so that the engagement perforation 7 thereof will engage the pawl 3, and prevents the film 2 from coming off. For this reason, a hole 8 for exposing the pawl 3 is formed in the pressing plate 5 so as to prevent the pressing plate 5 from pressing the pawl 3 down and the film 2 from coming off. The pressing plate 5 is bonded as shown in FIG. 1 at 5*a* to a leader surface 1*b* lying on the side opposite to the side where the elongated opening 4 is formed with the pawl 3 intervening between these sides.

The leader 1 has in its central portion a series of rectangular holes 1*c* equidistantly spaced from each other. These rectangular holes 1*c* are adapted to engage a sprocket provided within the development processing part of the developing apparatus. Hence, when the sprocket rotates, the leader 1 is fed.

Figure 2:
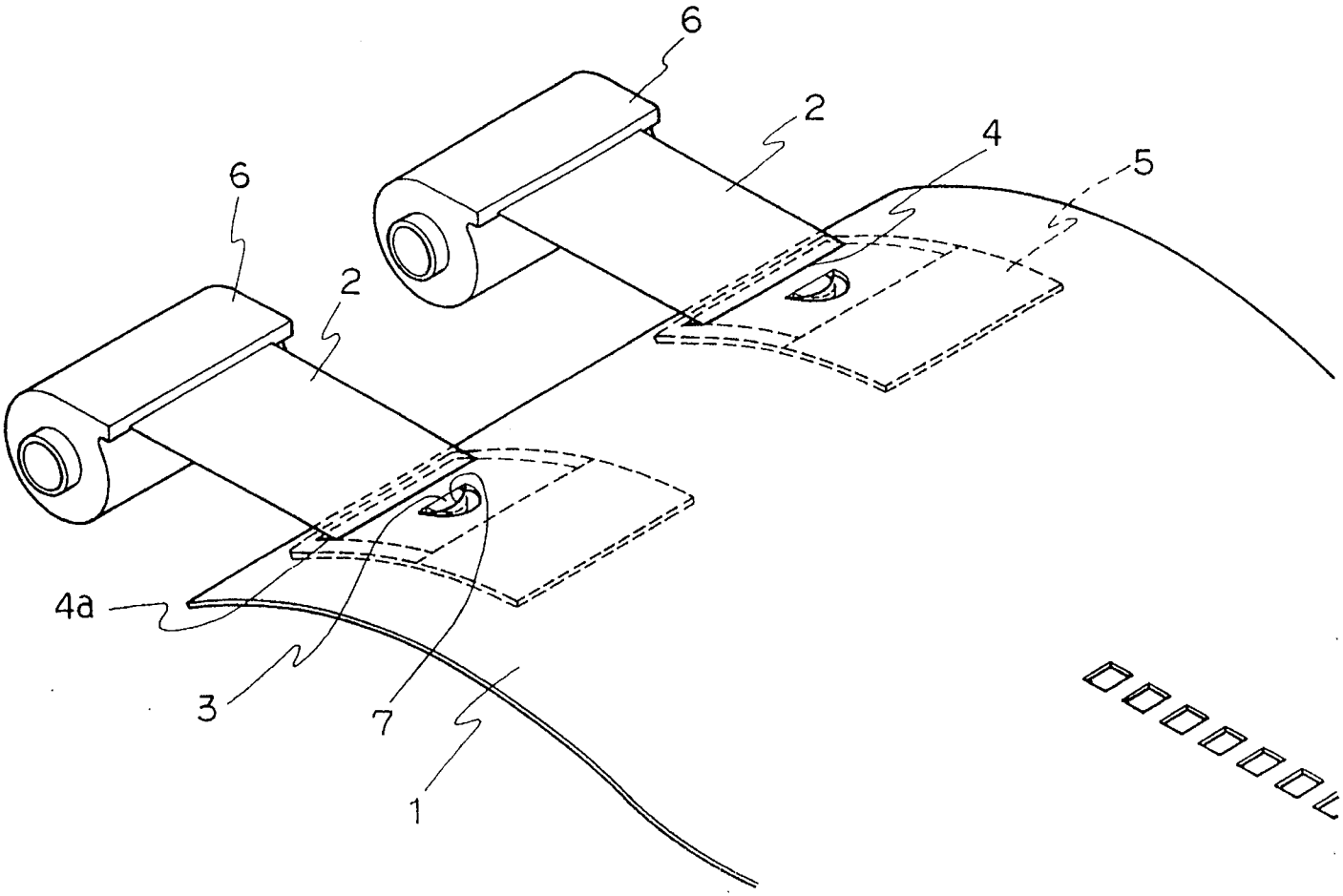
FIG. 2 is an explanatory view for illustrating a method for attaching the leader shown in FIG. 1 to a film.

To be described with reference to FIG. 2 is a method for attaching the aforementioned leader 1 to the film. In FIG. 2, the leader 1 is in its turned-over condition where the pressing plate 5 lies on the lower side and the elongated opening 4 on the upper side.

The end portion of the leader 1 to which the film 2 is to be attached is made to curve so that the pressing plate 5 lies inside the curve and that a transverse axis of the elongated opening 4 extends in the circumferential direction of the curve. The leading end of the film 2 is then inserted into the elongated opening from the outside of the substantially circular arc thus formed at an appropriate angle with respect to the transverse axis of the elongated opening 4. In this way, the insertion of the leading end of the film 2 into the elongated opening is facilitated. Further, the leading end of the film 2 being inserted is brought into contact with the pressing plate 5, then directed toward the leader surface, and made to slide on the leader surface, so that the engagement perforation 7 of the film 2 engages the pawl 3 without fail.

Figure 3:
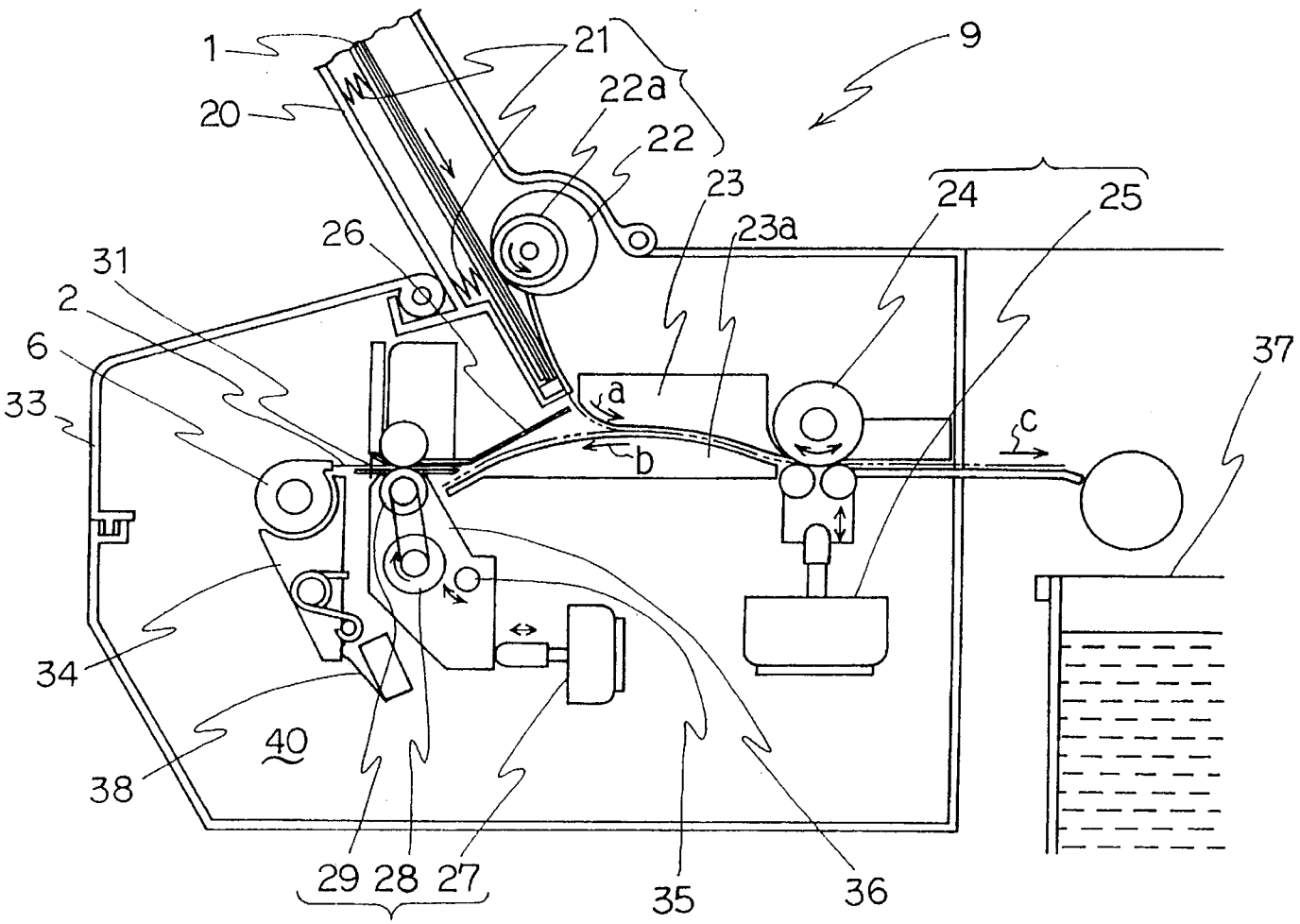
FIG. 3 is a schematic side sectional view of an apparatus for automatically attaching the leader to the film according to the present invention.

To be described with reference to FIG. 3 is an apparatus 9 for automatically attaching the leader to the film (hereinafter referred to as "automatic leader-attaching apparatus") which carries out the aforementioned method for attaching the leader to a film. The automatic leader attacher apparatus 9 includes a leader set cover 20; leader feed means A having a spring 21, a leader feed roller 22*a* and a leader feed motor 22; leader backing means B having a leader guide 23 defining an arcuate path, a drive roller 24 and a solenoid-type presser 25; film feed means C having a leader controlling part 26, a solenoid-type film presser 27, a drive motor 28 and a film feed roller 29; and film cut means having a cutter 31 and a cutting solenoid 32.

Within the leader set cover 20 are held a plurality of leaders same as the leader 1 shown in FIG. 1, each of which is positioned with its end portion to be attached to the film 2 being located above and with its face having the pressing plate 5 being oriented downward. Each leader 1 is biased against the leader feed roller 22*a* by the spring 21. When the leader feed motor 22 is actuated to rotate the leader feed roller 22*a* in the direction indicated by the arrow, the uppermost leader 1 advances in the direction indicated by arrow a along the leader guide 23. When the rear end of the leader 1 passes the leader feed roller 22*a*, the solenoid-type presser 25 is turned on to rotate the drive roller 24 forwardly. In turn, when the rear end portion of the leader 1 is positioned completely below the leader controlling part 26, the drive roller 24 is rotated reversely to back the leader 1 in the direction indicated by arrow b. This causes the rear end portion of the leader 1 to be curved along the lower guide 23*a* of the leader guide 23 by means of the leader controlling part 26. Thus, the leader 1 is held as curved as shown in FIG. 2 (refer to the chain double-dashed line in FIG. 3).

On the other hand, a film inlet cover 33 is opened and the cartridge 6 is set on a support 34. When the solenoid-type film presser 27 is turned off, a bracket 36 pivots about a shaft 35, so that the film feed roller 29 is lowered. The leading end of the film 2 is then placed on the film feed roller 29 thus lowered. In turn, when the solenoid-type film presser 27 is turned on, the film feed roller 29 rises so as to press the film 2 against the idle roller, and then the drive motor 28 is actuated to rotate the film feed roller 29 so as to feed the film 2 a predetermined distance.

Thus, the leading end of the film 2 is fed toward the elongated opening 4 of the leader 1 which is held in curved disposition by the leader guide 23 at an appropriate angle, so that the film 2 is assuredly inserted into the elongated opening 4 and attached to the leader 1. Thereafter, the leader 1, thus attached to the film 2, is fed in the direction indicated by arrow c by means of the drive roller 24 and film feed roller 29 to go round in processing tanks 37. When the film 2 in the form of a roll is completely drawn out of the cartridge 6 and the cartridge 6 is pulled and rotated by film 2, a limit switch 38 detects the rotation of the cartridge 6, whereupon the cutter 31 is caused to cut off the rear end of the film 2. Then the cartridge 6 falls into a receiver 40 and held therewithin.

Figure 4:
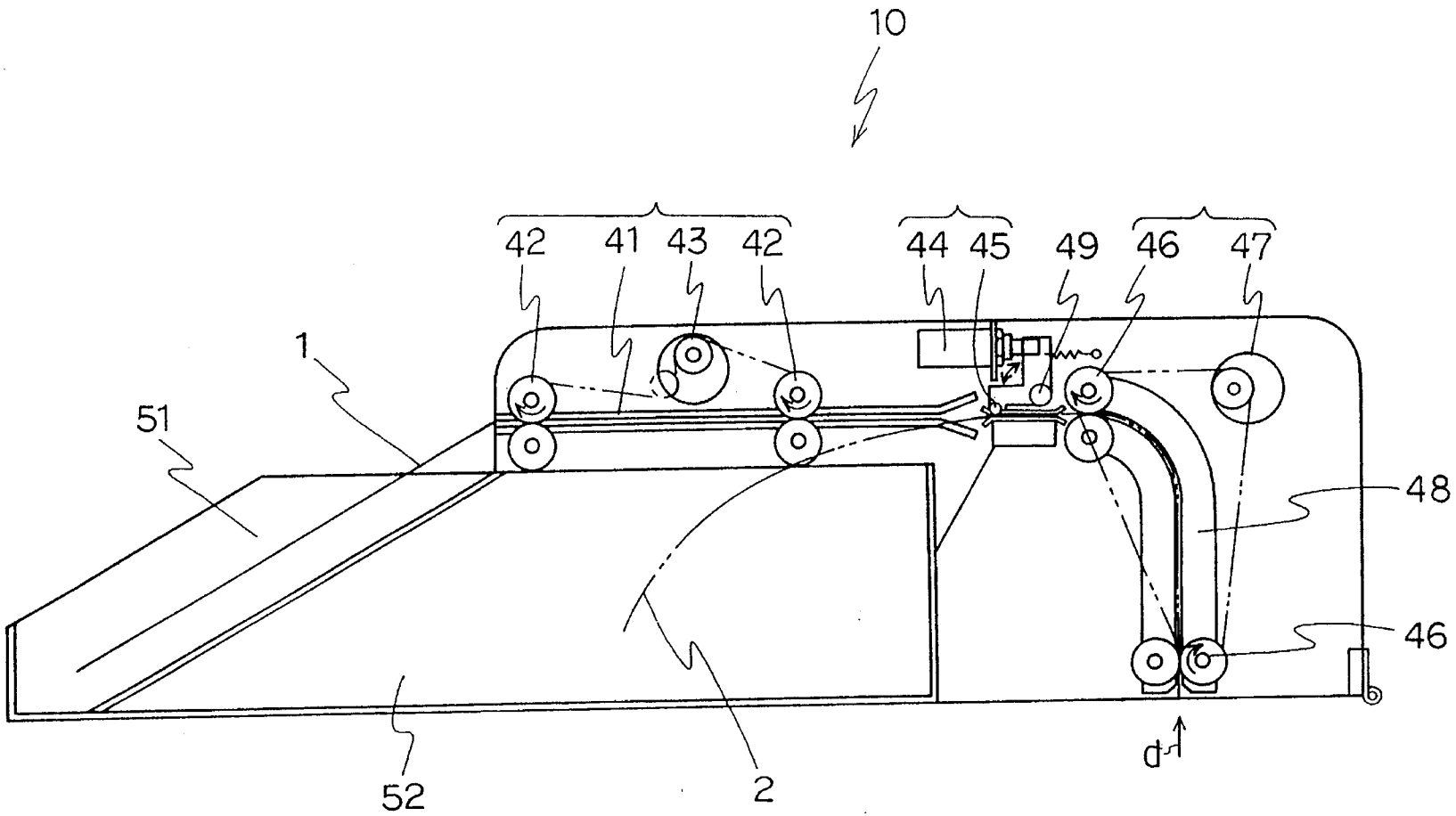
FIG. 4 is a schematic side sectional view of an apparatus for automatically detaching the leader from the film according to the present invention.

Description with reference to FIG. 4 is then made on a method for detaching the leader from the film and an apparatus 10 for automatically detaching the leader from the film (hereinafter referred to as "automatic leader detaching apparatus").

The automatic leader detaching apparatus 10 includes leader feed means D having a leader guide 41, a pair of spaced leader feed 42 and a drive motor 43; pawl pressing means E having a solenoid-type pawl presser 44 and a pawl pressing roller 45; and film forwarding and backing means F having a film feed roller 46 and a drive motor 47. The pawl pressing roller 45 is so made as to allow the film 2 to slide on the pawl 3 even when the pawl pressing roller 45 is depressing the pawl 3. The pawl pressing roller 45 might be in any other form as far as such function of the pawl pressing roller 45 is assured. For instance, the pawl pressing roller 45 might be in the form of a ball rotatably supported, or might be a member having a merely cylindrical or spherical surface made from a slippery material.

The leader 1 fed in the direction indicated by arrow d via the processing tanks and a drying chamber and attached to the film 2 passes through the guide 48 and is then held by the leader guide 41. When the pawl 3 lying adjacent the rear end of the leader 1 reaches a point just below the pawl pressing roller 45, the drive motor 43 stops operating and the leader 1 is fixedly held by the leader feed roller 42. Thereafter, only the film feed roller 46 is made to slightly rotate to cause only the film 2 to advance a little so that the center of the engagement perforation 7 of the film 2 will be aligned on the center axis of the pawl 3 so as to prevent a portion of the film 2 around the engagement perforation 7 from being pinched by the pawl 3. In turn, when the solenoid-type pawl presser 44 is turned on, the pawl pressing roller 45 pivots about a shaft 49 to press the pawl 3 collapsingly. With the pawl being kept collapsingly pressed, reverse rotation of the film feed roller 46 by a predetermined distance allows the film 2 to slide on the pawl 3 and to be detached from the leader 1. Thereafter, when the leader feed roller 42 and film feed roller 46 are made to rotate, the leader 1 and the film 2 are ejected into a leader stocker 51 and a film stocker 52, respectively, and are held therein.

Figure 5:
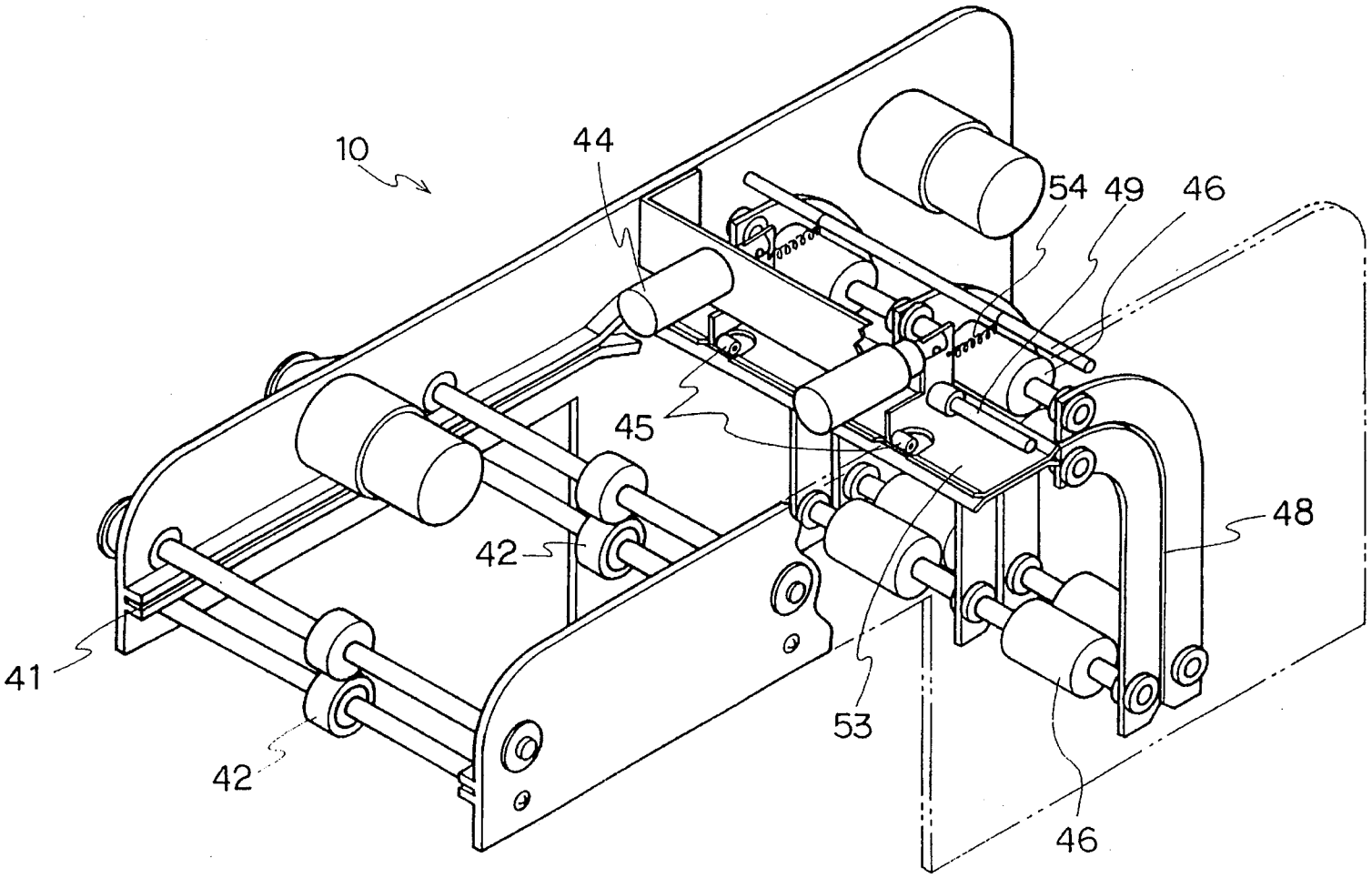
FIG. 5 is an explanatory perspective view of the apparatus shown in FIG. 4.

FIG. 5 is a perspective view showing the principal portion of the automatic leader detaching apparatus 10 shown in FIG. 4. The leader 1 is guided to the leader guide 41 by the guide 48 and temporarily held fixedly by being pressed against the leader feed rollers 42. The film feed roller 46 is then made to rotate slightly to align the center of the engagement perforation 7 of the film 2 on the center axis of the pawl 3. The pawl pressing roller 45 is rotatably mounted on the bracket 53 which is pivotally supported on the shaft 49, and is pressed downward when the solenoid-type pawl presser 44 is turned on. When the film feed roller 46 is made to rotate reversely while the pawl pressing roller 45 presses down the pawl 3 of the leader 1, the leader 1 can be detached from the film 2. When the solenoid-type pawl presser 44 is turned off, the pawl pressing roller 45 restores its initial condition by means of a spring 54 thereby releasing the pressure on the pawl 3. Finally, the film 2 is transferred downwardly of the leader guide 41 by means of the film feed roller 46 and then held within the film stocker 52, while the leader 1 is transferred by the leader feed roller 42 and then held within the leader stocker 51.

Figure 6:
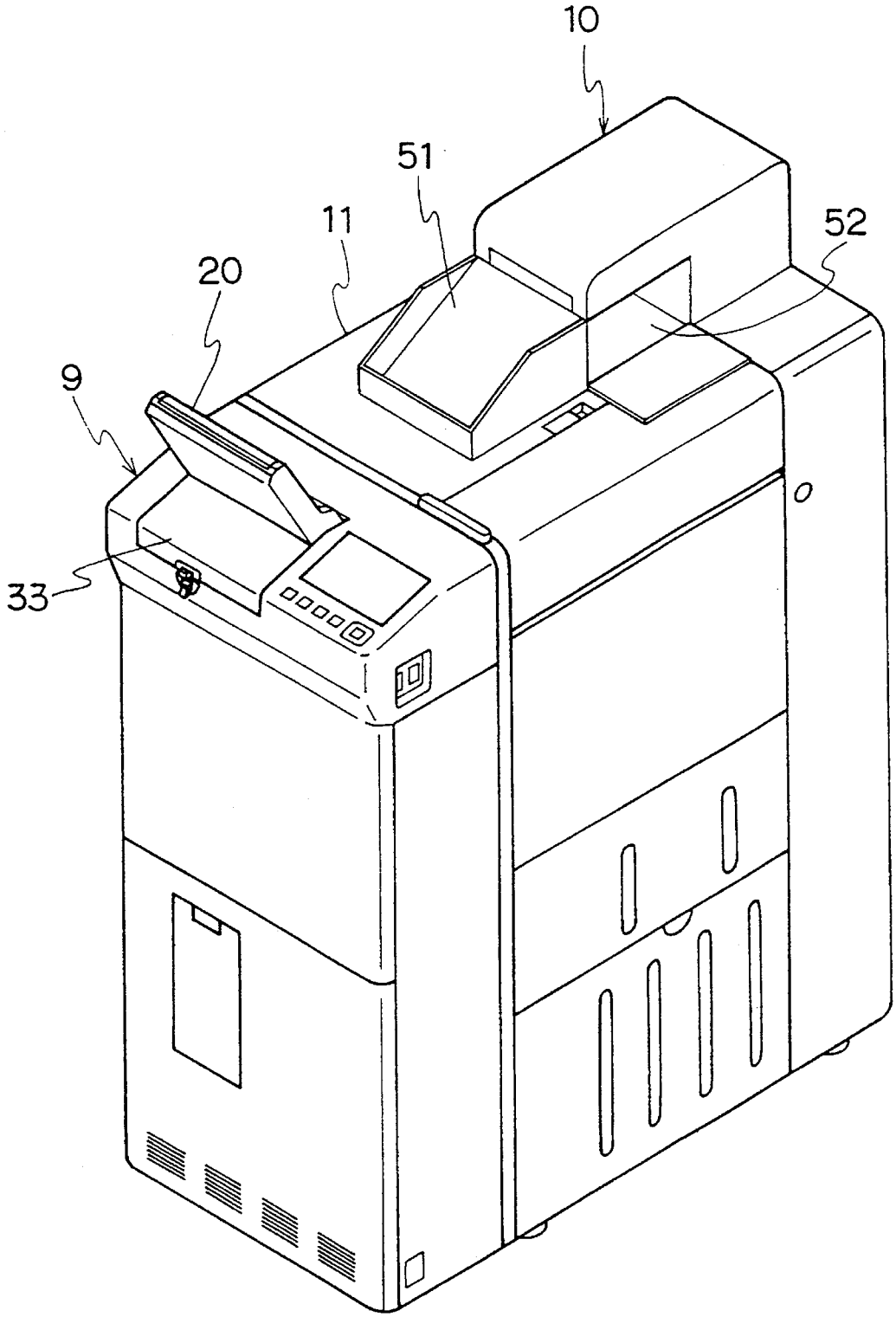
FIG. 6 is an overall perspective view of a developing apparatus with automatic leader attachment and detachment.

FIG. 6 is an overall perspective view of a developing apparatus, wherein numeral 11 denotes a development processing part for developing the film 2 introduced thereinto. The aforementioned automatic leader attaching apparatus 9 is mounted on the upper front portion of the development processing part 11, and the automatic leader detaching apparatus 10 is mounted on the rear portion of the development processing part 11. This automatic leader attachment and detachment type developing apparatus operates as follows.

The cartridge 6 is set on the apparatus 9 at a predetermined position by opening the film inlet cover. Within the leader set cover 20 are held a plurality of leaders 1 in advance. The film 2 is drawn out of the cartridge 6, attached to the leader 1 automatically and introduced into the development processing part 11 when a button is manipulated. The development processing part 11 includes film processing tanks such as a developer tank and a fixer tank. Feeding the leader 1 by means of the sprocket causes the film 2 to be developed then dried in the drying chamber and to be sent to the automatic leader detaching apparatus 10. The leader 1 is detached from the film 2 in the automatic leader detaching apparatus 10 and then ejected into the leader stocker 51, while the film 2 is ejected into the film stocker 52 and kept therein.

It should be understood that although the film 2 is provided with only one engagement perforation 7 in the foregoing embodiment, the film 2 might be provided with a plurality of engagement perforations. In this case, the number of pawls 3 should correspond to the number of the engagement perforations 7. Further, in the embodiment the tongue portion in the leading end portion of the film 2 is cut off in advance and then the engagement perforation 7 is formed. However, in the case of a film having the engagement perforation 7 formed beforehand, the pawl 3 matched to such engagement perforation is provided to the leader 1.

As has been described, according to the leader and methods for attaching the leader to the film and detaching it therefrom, the leader can easily be attached to the film by merely inserting the leading end of the film into the elongated opening of the leader if the engagement perforation is provided in the leading end portion of the film, and the leader can easily be detached from the film by merely drawing the film while collapsingly pressing the pawl. Further, according to the automatic leader attachment and detachment type developing apparatus, the film is automatically developed, and ejected separately from the leader by merely setting the cartridge on the apparatus at a predetermined position.

It should be understood that the apparatus and methods which have been shown and described herein are illustrative of the invention and are not intended be limitative thereof. Clearly, those skilled in the art may conceive of variations or modifications to the invention. However, any such variations or modifications which falls within the purview of this description are intended to be included therein as well. The scope of the invention is limited only by the claims appended hereto.

What is claimed is:

1. A leader to be attached at one end portion thereof to a film having an engagement perforation in a leading end portion thereof, comprising:

(a) a leader body;

(b) a pawl formed adjacent one end of the leader body projecting from a surface of the leader body and having a tip inclined in a direction in which the leader is to be fed;

(c) an elongated opening formed intermediate the one end of the leader body and the pawl and having a length slightly larger than a width of the film, the opening having a longitudinal axis extending parallel to an edge of the one end of the leader body; and (d) a pressing plate disposed on a surface of the leader body from which the pawl projects and being fixed to said surface on a side of the pawl which is opposite to that on which the elongated opening is formed, said pressing plate having a hole overlying and exposing the pawl, so as to allow the film inserted between the pressing plate and the leader body through the elongated opening to slide therebetween until the engagement perforation of the film engages the pawl.

2. A method for attaching a leader to a film having an engagement perforation in a leading end portion thereof in which said leader includes a leader body having a pawl projecting from a surface adjacent an end thereof with a tip inclined in a direction in which the leader is to be fed, said leader body further including an elongated opening sized to receive the film disposed intermediate the end thereof and the leader body and a pressing plate fixed to the surface of the leader body from which the pawl projects on a side of the pawl opposite that on which the elongated opening is formed and having a hole for exposing the pawl, said method comprising the steps of:

(a) curving the leader body at the one end portion thereof in such a manner that a transverse axis of the elongated opening extends in a circumferential direction of a resulting substantially circular arc and that the face of the leader body on which the pressing plate is disposed forms an inner periphery of the arc; and (b) inserting the film into the elongated opening from outside of the arc to engage the engagement perforation of the film with the pawl.

3. A method for detaching a leader attached to a film having an engagement perforation in a leading end portion thereof in which said leader includes a leader body having a pawl projecting from a surface adjacent an end thereof with a tip inclined in a direction in which the leader is to be fed, said leader body further including an elongated opening sized to receive the film disposed intermediate the end thereof and the leader body and a pressing plate fixed to the surface of the leader body from which the pawl projects on a side of the pawl opposite that on which the elongated opening is formed and having a hole for exposing the pawl, said method comprising the steps of:

(a) fixedly holding the leader body attached to the film;

(b) slightly moving the film with respect to the leader to disengage the engagement perforation from the pawl; and (c) reversing the movement of the film for drawing the film away from the leader while collapsingly pressing the pawl.

4. An apparatus for automatically attaching a leader to a film having an engagement perforation in a leading end portion thereof in which said leader includes a leader body having a pawl projecting from a surface adjacent an end thereof with a tip inclined in a direction in which the leader is to be fed, said leader body further including an elongated opening sized to receive the film disposed intermediate the end thereof and the leader body and a pressing plate fixed to the surface of the leader body from which the pawl projects on a side of the pawl opposite that on which the elongated opening is formed and having a hole for exposing the pawl, said method comprising:

(a) a leader set cover for holding a plurality of leaders in such a manner that each of the leaders is positioned as having the one end portion for film attachment lying rearward;

(b) a leader guide defining an arcuate path;

(c) leader feed means for feeding each of the leaders held by the leader set cover to the leader guide;

(d) leader backing means, provided adjacent one end of the leader guide, for moving backward the leader fed to the leader guide;

(e) a leader controlling part for controlling the one end portion of the leader moved backward by the leader backing means to curve the one end portion of the leader along the leader guide; and (f) film feed means for drawing the film out of a cartridge accommodating the film in the form of a roll to feed the film toward the elongated opening of the leader being kept curved at the one end portion thereof, whereby the leading end of the film having the engagement perforation is attached to the leader.

5. An apparatus for automatically detaching a leader attached to a film having an engagement perforation in a leading end portion thereof in which said leader includes a leader body having a pawl projecting from a surface adjacent an end thereof with a tip inclined in a direction in which the leader is to be fed, said leader body further including an elongated opening sized to receive the film disposed intermediate the end thereof and the leader body and a pressing plate fixed to the surface of the leader body from which the pawl projects on a side of the pawl opposite that on which the elongated opening is formed and having a hole for exposing the pawl, said method comprising:

(a) leader feed means for fixedly holding the leader attached to the film and then feeding the leader;

(b) pawl pressing means for collapsingly pressing the pawl of the leader; and (c) film forwarding the backing means, provided adjacent the pawl pressing means and on a side adjacent a passage of the film, for forwarding the backing only the film with the leader fixedly held.

* * * * *